US012043427B2

(12) United States Patent
Scapin et al.

(10) Patent No.: US 12,043,427 B2
(45) Date of Patent: Jul. 23, 2024

(54) METHOD FOR PACKAGING A PLURALITY OF CONTAINERS AND RELATED PACKAGING OF CONTAINERS

(71) Applicant: GAMPACK S.R.L., Piacenza (IT)

(72) Inventors: Amedeo Scapin, Resana (IT); Tiziano Tavani, Piacenza (IT)

(73) Assignee: GAMPACK S.R.L., Piacenza (IT)

( * ) Notice: Subject to any disclaimer, the term of this patent is extended or adjusted under 35 U.S.C. 154(b) by 115 days.

(21) Appl. No.: 17/821,510

(22) PCT Filed: Feb. 17, 2021

(86) PCT No.: PCT/IB2021/051340

§ 371 (c)(1),
(2) Date: Aug. 23, 2022

(87) PCT Pub. No.: WO2021/171142

PCT Pub. Date: Sep. 2, 2021

(65) Prior Publication Data

US 2023/0356868 A1 Nov. 9, 2023

(30) Foreign Application Priority Data

Feb. 25, 2020 (IT) ..... 102020000003865

(51) Int. Cl.
*B65B 17/02* (2006.01)
*B65B 15/00* (2006.01)
(Continued)

(52) U.S. Cl.
CPC ..... *B65B 15/00* (2013.01); *B65B 17/02* (2013.01); *B65B 43/10* (2013.01); *B65B 61/02* (2013.01)

(58) Field of Classification Search
CPC ..... B65B 15/00; B65B 61/02; B65B 11/08; B65B 43/10; B65B 17/02; B65D 71/0085
(Continued)

(56) References Cited

U.S. PATENT DOCUMENTS

2016/0090223 A1* 3/2016 Newman ..... B65B 61/14 53/397
2021/0403216 A1* 12/2021 Mills ..... B65B 5/06

FOREIGN PATENT DOCUMENTS

DE 102018115999 A1 * 1/2020
EP 0481695 A1 4/1992
(Continued)

OTHER PUBLICATIONS

International Search Report and Written Opinion for Corresponding International Application No. PCT/IB2021/051340, 10 pages, Jun. 9, 2021.

*Primary Examiner* — Chinyere J Rushing-Tucker
(74) *Attorney, Agent, or Firm* — Lucas & Mercanti, LLP

(57) ABSTRACT

A method of packaging a plurality of food containers and a package for food containers are disclosed. The method is fast and inexpensive and optimizes the use of cardboard or paperboard to make the package without plastics and may be used in the mass production of packaging for containers. The package is defined by a plurality of containers placed on a tray of optimal dimensions according to the dimensions of the containers. The tray is creased and has two side flaps that can be rotated to attach to the side faces of the containers by glue. The extension of the flaps is proportional to the height of the containers and the flaps can be punched in order to have aesthetically appreciable shapes and to reduce the bulk and the risk of breaking the package made.

10 Claims, 3 Drawing Sheets

(51) Int. Cl.
*B65B 43/10* (2006.01)
*B65B 61/02* (2006.01)

(58) Field of Classification Search
USPC ..... 53/397
See application file for complete search history.

(56) References Cited

FOREIGN PATENT DOCUMENTS

| | | | | |
|---|---|---|---|---|
| EP | 1375363 | A2 * | 1/2004 | ..... B65D 5/5035 |
| FR | 2986221 | A1 | 8/2013 | |
| WO | 2009024618 | A1 | 2/2009 | |
| WO | WO-2009024618 | A1 * | 2/2009 | ..... B65D 71/0007 |
| WO | 2020202016 | A1 | 10/2020 | |

* cited by examiner

METHOD FOR PACKAGING A PLURALITY OF CONTAINERS AND RELATED PACKAGING OF CONTAINERS

CROSS-REFERENCE TO RELATED APPLICATIONS

This application is a 371 of PCT/IB2021/051340, filed Feb. 17, 2021, which claims the benefit of Italian Patent Application No. 102020000003865, filed Feb. 25, 2020.

TECHNICAL FIELD

The present description relates to a method of packaging a plurality of food containers and the so obtained packaging of containers.

BACKGROUND

Packages are known for a plurality of food containers such as beverages or food in liquid form (ie milk and liquid derivatives, fruit juices, protein solutions) in plasticized cardboard, generally in the shape of a parallelepiped, on whose front and side faces are printed, in particular, the name of the contained food product, the manufacturer's logo, a nutritional table and a list of ingredients. Such packages are defined by an envelope made of plastic, cardboard or paperboard which covers these containers on at least four faces. A first example is given by cream packages: a plurality of containers, generally three containers of 125 mL each, are wrapped in a transparent plastic film bearing only the bar code of the package.

This configuration guarantees the compactness of the package, a minimum encumbrance due to the negligible thickness of the plastic tape and the absence of the need to include a printing process on this film, as all commercial information is already visible on the surfaces of the containers themselves. The main critical issues related to these known packages are the use of plastic material and the difficulty in ensuring the integrity of the package, since the individual containers could be made to slide out of the film that should wrap them and be dispersed.

Another solution, widely adopted in the market to avoid the use of plastics is the exclusive use of paper material, as in the case of the packaging of fruit juices. These packages include at least two fruit juice containers, whose volume per container is generally 250 mL, which are aligned and made to adhere, by means of glue zones defined on the base of each container, to a wrapper made of cardboard that wraps the containers, generally covering four faces and leaving one side face of the first and one of the last wrapped container uncovered. In this way, information such as the bar code of the package, the nutritional table and the list of ingredients of the fruit juice contained in the containers are made visible. Generally, there is also a window cut out on one face of the casing and in correspondence with one of the containers, in order to allow the display of information such as the batch number and the expiry date of the fruit juice.

This configuration guarantees a package that can be easily displayed on a counter, involving a minimum footprint thanks to the reduced thickness of the cardboard, and handled by the customer without the risk of the individual containers coming out of the wrapping. Similar solutions are also used for containers with a volume greater than 500 mL, therefore heavier. The production of cardboard envelopes involves an abundant use of cellulose and forces the manufacturer to include a printing step on the entire outer surface of each envelope to ensure that the package is easily identifiable and traceable to the specific product of the specific manufacturer. Furthermore, in the case of heavier containers, an envelope made of thicker material such as corrugated cardboard is required, capable of supporting a greater weight, but which entails a greater bulk on the display counter due to the greater thickness of the package. The cost of packaging is therefore aggravated by the cost of the cardboard or card needed to make the wrappers and by the printing process. In particular, since there is no adhesion of the containers to the support base by means of glue points, the weight force of the single container, subjecting the support base itself to considerable strain, creates a consequent risk of breakage in the event that the material of which the tray is made is not suitable for the weight of the containers.

Further examples of packages for similar containers, of variable size according to their volume, are known, where the packages are each defined by a tray made of cardboard or paperboard. The tray is generally defined by a support base on which the containers are glued by applying glue to the bottom of the containers themselves and by raised edges that surround the containers, partially covering all the side faces. This configuration has the advantage, for the manufacturer, of not necessarily having to foresee an expensive printing process on the tray, as it does not fully cover the packaged products and the information relating to the product is immediately visible.

The criticality in the use of trays lies in the need to use a material suitable for the dimensions of the containers: containers with a volume greater than 500 mL, therefore heavier, require thicker cardboard trays than the example of fruit juices, or corrugated cardboard, so that this tray can support the weight of the containers. Consequently, the size of the package increases due to the increase in thickness of the tray, as well as making the package less attractive due to the imperfection caused by a bulky container. A further problem is given by the fact that the prominent vertices of the trays, where with prominent vertices we mean the points of intersection of a lateral flap with a transverse flap, risk hindering the handling of the package, getting stuck or entangled with other contiguous packages on the counter, even damaging the casings of the latter packages.

SUMMARY

An object of the present description is therefore to provide a simplified, quick and economical method for manufacturing a package for food containers to be displayed on a counter.

A second purpose is the implementation of this method in a continuous line for the mass production of such packages for food containers.

A third purpose is the creation of a package that presents a reduced risk of breakage when handled while minimizing the size of the package itself.

A fourth purpose is the optimization of the type and quantity of material used for the realization of this package, using only paper material for the realization of a tray, in sufficient quantity to guarantee the stability of the containers retained by the tray itself and guarantee the display of the information content present on the surface of the containers themselves, thus making it unnecessary to further print the same information content on the tray but limiting this process to the affixing of essential data such as a bar code, an expiration date and a number of batch, thus reducing the cost of manufacturing the package.

A fifth object of the present disclosure is to provide a tray with an aesthetically pleasing shape, which does not involve the risk of damaging other contiguous packages and which facilitates handling of the package itself.

These objects are achieved with the packaging, according to this disclosure, of containers for food and the production method for obtaining it, the main characteristics of which are specified in the attached claims.

BRIEF DESCRIPTION OF THE DRAWINGS

Further advantages and characteristics of the production method and of the packaging will become evident to those skilled in the art from the following detailed and non-limiting description of embodiments with reference to the attached drawings in which.

DETAILED DESCRIPTION OF THE INVENTION

Referring to FIGS. 1*a-d*, the method of packaging a plurality of food containers, comprising a substantially parallelepiped-shaped lower portion, comprises the steps illustrated below, according to a first aspect of this disclosure.

Aligning a plurality of containers 1 along a single row according to a main alignment direction Y. The containers 1, generally made of plasticized cardboard, are characterized by a lower portion and an upper portion. This lower portion is substantially parallelepiped-shaped and comprises a part of the container 1 defined by a lower base, two main faces A and two lateral faces B. The upper portion includes the opening system of the container and can assume different geometries depending on the type of container 1; therefore it can be substantially planar and parallel to the lower base, planar and oblique with respect to the lower base, or similar in shape to a prism.

Figure 1A:
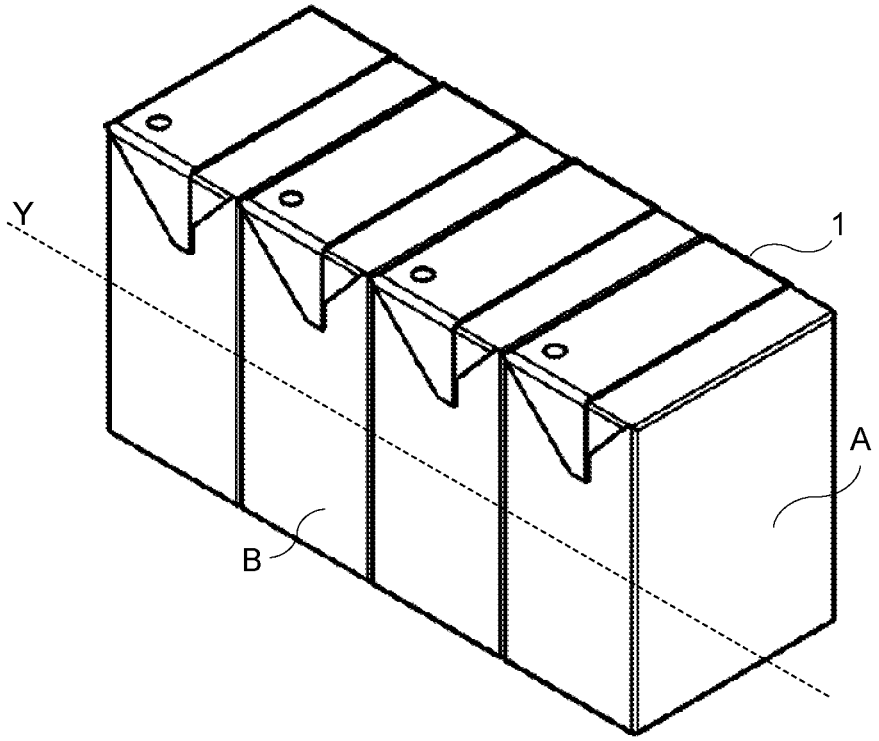
FIG. 1*a* shows a perspective view of a row of food containers.
Figure 1B:
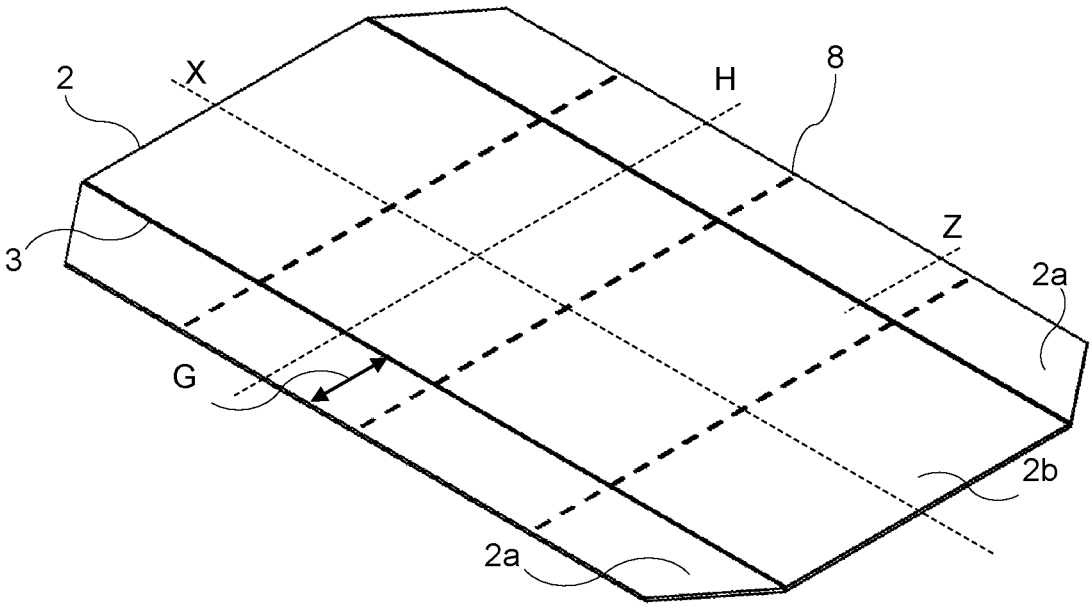
FIG. 1*b* shows a perspective view of a cardboard or paperboard tray.
Figure 1C:
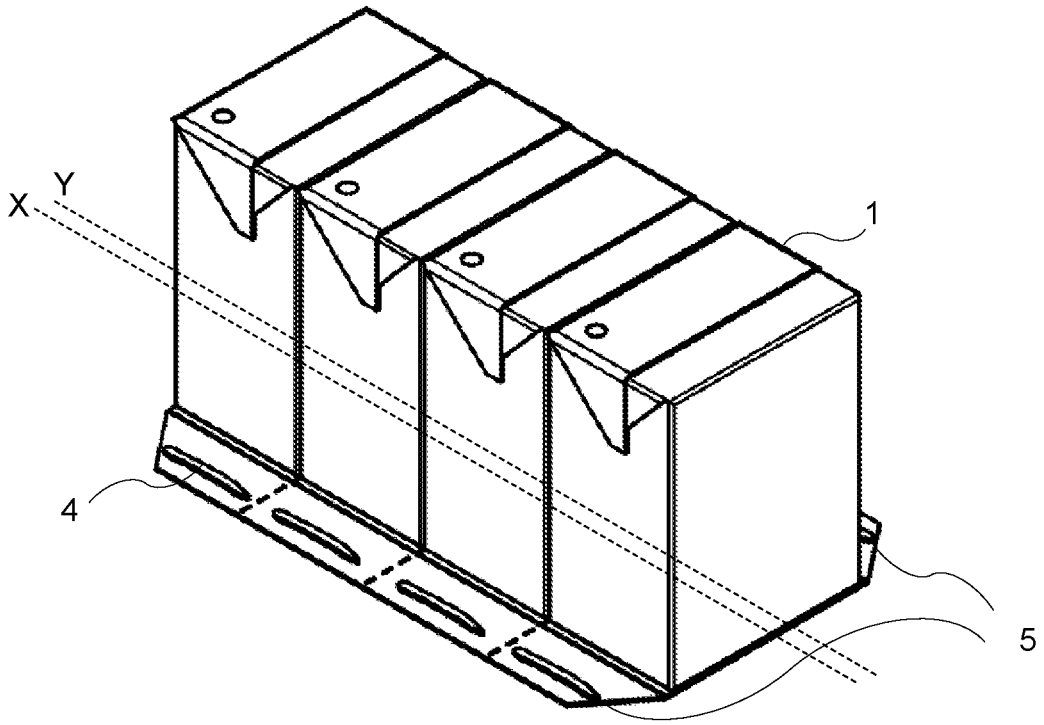
FIG. 1*c* shows a perspective view of the food containers of FIG. 1*a* resting on the tray of FIG. 1*b;*
Figure 1D:
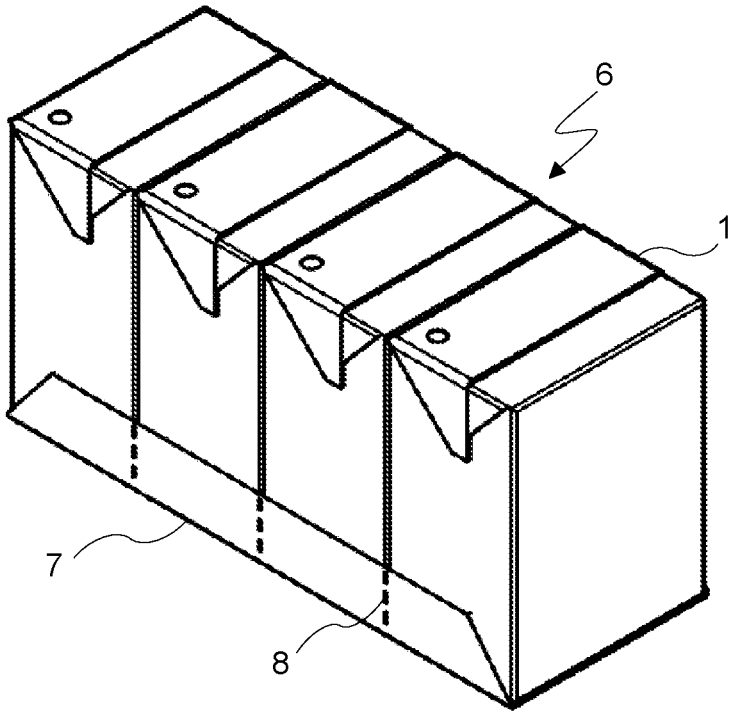
FIG. 1*d* shows a perspective view of a package of food containers.

In FIG. 1*a* plurality of four containers 1 is depicted, but it is evident that the method of the present disclosure may be used for a different number of containers 1. The dimensions of the containers 1 can vary according to the contained volume, the opening mechanism used and from choices of the single producer. For example, containers 1 with parallel opposite faces or containers 1 of different design can be used, with opening system by perforation, cutting, door, screw cap or other solutions. In particular, the single container 1 can be provided with a straw, generally glued to one of the main faces A by means of a glue point. Faces A, B of each container can be printed with a name of the contained food product, a manufacturer's logo, a nutritional table and a list of ingredients, batch number, expiry date, barcode, certifications, advertising images or others useful information for the consumer. The alignment of these containers 1 is carried out so that at least one main face A, perpendicular to the main alignment direction Y, of each container 1 is abutting a respective main face A of the next container 1 and that side faces B of the containers 1, parallel to the main alignment direction Y, lie in the same plane.

According to the method of this disclosure, a cardboard or paperboard tray 2 is obtained, for example with a thickness of at least 0.5 mm, having a longitudinal development direction X, further comprising only two straight creases 3, parallel to the longitudinal development direction X, which extend along a longitudinal extension of the cardboard or paperboard tray 2. The two creases 3 thus created define a support base 2*b*, comprised between the two creases 3, and two side flaps 2*a* on the sides of the support base 2*b* respectively to the right and to the left of the longitudinal development direction X; the longitudinal extension of the cardboard or paperboard tray 2 according to the longitudinal development direction X corresponds to a longitudinal extension of the row of containers 1 along the main alignment direction Y. A transversal extension of the support base 2*b* corresponds to a width F of the main faces A, and a maximum extension G of the side flaps 2*a* starting from the support base 2*b* according to a flap direction Z perpendicular to the creases 3 is between 10% and 30% of the height of the containers 1.

Defining a cardboard or paperboard tray 2 of optimal size according to the size of the containers 1 has the advantage of being able to optimize the consumption of material for making the tray 2 itself.

Tests carried out by the applicant have shown that, for the typically used cardboard or paperboard trays 2, defining flaps 2*a* having a maximum extension G less than 10% of the height of each container 1 is not effective in ensuring the desired strength of the package 6. Experimentally, it has been noticed that with maximum heights of the fins 2*a* less than 10% of the height of the container 1, the fins 2*a* of the packages 5 break when handled without particular care. It has also been seen that, with maximum extensions G of the fins 2*a* above 30%, there is no significant further advantage from the point of view of the solidity of the package 6.

Once the cardboard or paperboard tray 2 has been procured, the containers 1 are placed aligned on this support base 2*b* so that the main alignment direction Y is parallel to the longitudinal development direction X, and that a bottom surface of each container 1 is in contact with the cardboard or paperboard tray 2 without interposition of glue.

According to the method of this disclosure, glue is applied in a plurality of pairs of gluing zones 5, where each gluing zone 4 of each pair of gluing zones 5 is defined on a respective free end portion of one of the fins 2*a* in opposite position with respect to the longitudinal development axis X, in correspondence with each container 1. These gluing zones 4 can be defined by applying glue on distinct points of the flap 2*a* or continuously in the form of strips of glue. The application of glue on the lateral flaps 2*a* of the tray 2, for each container 1, is advantageous with respect to the application of glue on single points in correspondence with the bottom surface of each container 1. The single container 1 is in fact bound to the two flaps 2*a*, which prevent its rotation with respect to the support base 2*b*. The optimization of the extension of the fins 2*a* as a function of the height of the single container 1 is intended as the minimum sufficient extension, starting from the creasing 3, where one of the two gluing areas 4 specific for the single container 1 can be defined so to guarantee the stability of the container 1 to which the fins 2*a* are glued. The adhesion of both flaps 2*a* to the containers 1 binds the containers 1 to the tray 2, and thus to the package 6, preventing any type of accidental movement. The separation of a container 1 from the package 6 may take place only by breaking the gluing areas 4 by applying force. Since the flaps 2*a* are relatively small, the consumer is not obstructed from viewing the information content present on the surfaces A, B of the containers 1, making the package 6 more aesthetically pleasing and allowing to limit any printing process of information content on a surface of the tray 2 to the barcode, expiration date or batch number.

Finally, the production of a package 6 of containers 1 is completed by rotating the flaps 2*a* with respect to the respective creases 3 so as to make the gluing areas 4 adhere to each of the containers 1.

According to one aspect, the cardboard or paperboard tray 2 used can be subjected to a creasing operation for the realization of the two straight creases 3, parallel to the longitudinal development direction X, which extend along the entire longitudinal development of the tray 2 The tray 2 can also be subjected to a punching operation to give the side flaps 2*a* a shape other than the rectangular one. In a preferred embodiment, the tray 2 is punched so that the side flaps 2*a* are substantially trapezoid-shaped, where the smaller base 7 of each of the trapezoid-shaped flaps 2*a* defines the free end of the flaps 2*a*. By doing so, there is the advantage of reducing the risk that the package 6 gets entangled or stuck when handled in contact with other packages, preventing accidental damage to the package 6 itself, for example due to breaking of the gluing areas 4.

According to one aspect, it is possible to produce weakening lines 8 on the tray 2 by means of pre-cuts along a transverse direction H, perpendicular to the longitudinal development direction X on the support base 2*b* of the cardboard or paperboard tray 2 which allow a physical separation of a portion of the plurality of containers 1 comprising at least one of the containers 1. By doing this, it is possible to facilitate tearing along preferential lines of portions of the package and the portion of tray 2*b* tied thereto.

According to one aspect, the manufacturing process of the package 6 can provide for the manufacturing of the tray 2 starting from a continuous ribbon of cardboard or paperboard wound on a roll. An exemplary process, shown schematically in FIG. 2, involves unwinding the tape from the roll, yielding the tape, and then cutting a portion of the tape to define the cardboard or paperboard tray 2. This allows the realization of a production process of packages 5 substantially identical in series and continuously.

Figure 2:
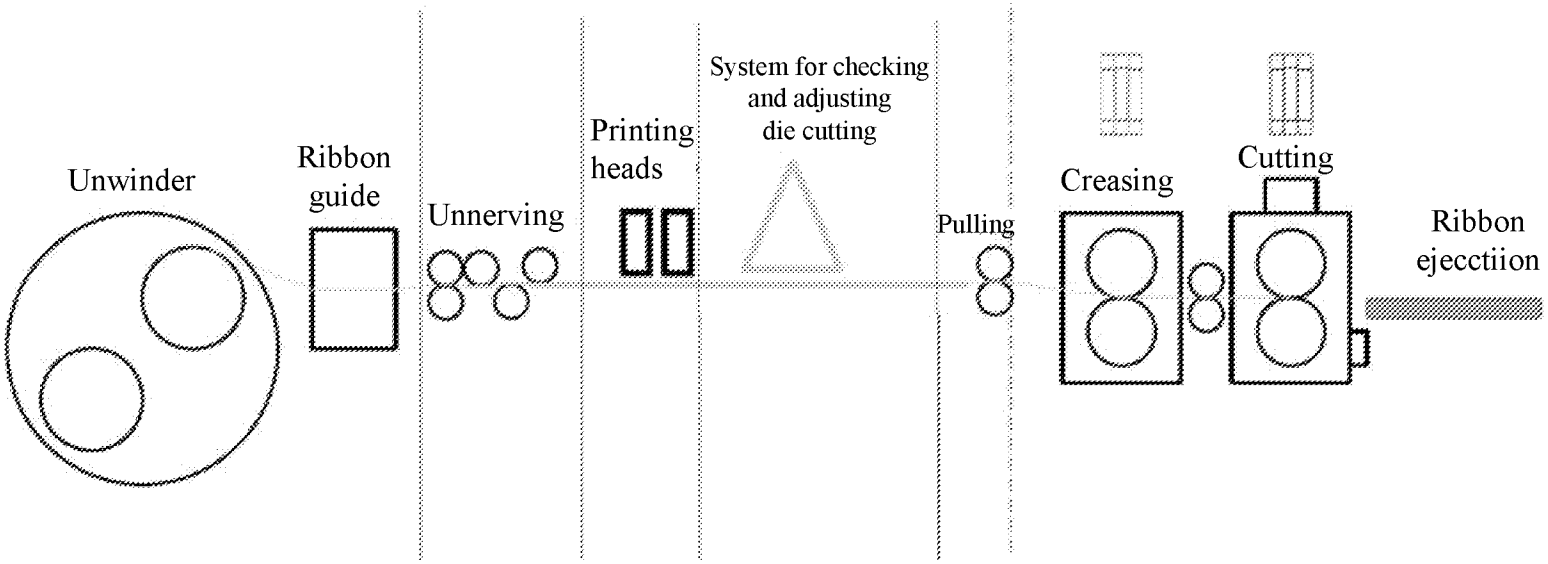
FIG. 2 schematically shows a production line of a tray usable in the packaging method of this disclosure, starting from a continuous cardboard or paperboard ribbon wound on a roll.

According to one aspect, a printing operation on tray 2 of images and texts can be included in the package manufacturing method, as indicated in FIG. 2. Even if all the information concerning the packaged product is visible on the surfaces of the containers 1, this allows the manufacturer to affix on the tray 2 elements such as, in particular, the barcode of the entire package 6, so that it can also be sold as a single item.

According to one aspect, the package 6 of containers 1 made by means of the described method has the characteristics and all the advantages mentioned above such as a minimization of the bulk and the risk of breakage when handled, the optimization of the type and of quantity of used material for the realization of this package 6. The tray 2 is made of paper material, in a quantity sufficient to guarantee the stability of the containers 1 held by the tray 2 itself, leaving the information content present on the surface of the containers 1 exposed, thus making it unnecessary the further printing, on tray 2, of the same information. The tray 2 is characterized by an aesthetically pleasing shape, which does not involve the risk of damaging other contiguous packages and which facilitates the handling of the package 6 itself.

The invention claimed is:

1. A method of packaging a plurality of containers, wherein each container of said plurality of containers comprises parallelepiped-shaped lower portion, comprising the steps of:

aligning said plurality of containers along a single row according to a main alignment direction, so that a main face, perpendicular to said main alignment direction, of each container of said plurality of containers is attached to a respective main face of an adjacent container and that lateral faces of said containers, parallel to said main alignment direction, lie on the same plane;

procuring a cardboard tray or paperboard tray, having a longitudinal development direction, also comprising only two rectilinear creases, parallel to said longitudinal development direction, which extend along an entire longitudinal extension of said cardboard tray or paperboard tray, and which define a support base, between said two creases, and a lateral flap at each side of said support base; the longitudinal extension of said cardboard tray or paperboard tray according to said longitudinal development direction corresponding to a longitudinal extension of said row of containers along the main alignment direction, a transverse extension of said support base corresponds to the width of said main faces, and a maximum extension of said side flaps starting from the support base according to a flap direction perpendicular to said creases of between 10% and 30% of the height of said containers;

placing the containers aligned on said support base so that the main alignment direction is parallel to the longitudinal development direction, wherein a bottom surface of each container is in contact with said cardboard tray or paperboard tray without interposition of glue;

applying glue in a plurality of pairs of gluing zones, where each gluing zone of each pair of gluing zones is defined on a respective free end portion of one of said flaps in a position opposite to said longitudinal development direction, in correspondence with each container; and producing a pack of containers by rotating the flaps with respect to the respective creases so as to adhere said gluing zones to each of the containers by means of said respective pairs of gluing zones.

2. The method of claim 1, further comprising a creasing operation of said cardboard tray or paperboard tray for making said two straight creases.

3. The method of claim 2, wherein said die-cutting operation is carried out so that said lateral flaps are trapezoid-shaped, wherein a minor base of each of said trapezoid flaps defines a free end of the flaps.

4. The method of claim 1, further comprising a die-cutting operation of said cardboard or paperboard tray.

5. The method of claim 1, further comprising realizing pre-cuts along a transverse direction perpendicular to said longitudinal direction of development on said support base of said cardboard tray or paperboard tray for the creation of weakening lines which allow a physical separation of a portion of said plurality of containers comprising of said containers and a portion of tray attached thereto.

6. The method of claim 1, wherein said cardboard tray or paperboard tray is obtained from a continuous cardboard tape or paperboard tape wound on a roller, by the following operations:

a. Unwinding the tape from said roller;

b. Weakening said tape; and c. Cutting a portion of said tape to define said cardboard tray or paperboard tray.

7. The method of claim 1, further comprising a printing operation of images and texts on said cardboard tray or paperboard tray.

8. A packaging of containers comprising a plurality of containers and a cardboard tray or paperboard tray, wherein each container comprises a parallelepiped-shaped lower portion, wherein said plurality of containers is aligned along a single row according to a main alignment direction, so that a main face, perpendicular to said main alignment direction, of each container is abutted against a respective main face of an adjacent container and that the lateral faces of the containers, parallel to said main alignment direction, lie on the same plane, in which said cardboard tray or paperboard tray, has a longitudinal development direction, further comprising only two rectilinear creases, parallel to said longitudinal development direction, which extend along the entire longitudinal extension of said cardboard tray or paperboard tray and which define a support base, between said two creases, and a lateral flap at each side of said support base; the longitudinal extension of said cardboard tray or paperboard tray according to said longitudinal direction of development corresponds to the longitudinal extension of said row of containers along the main alignment direction, the transversal extension of said support base corresponds to the width of said main faces, and the maximum extension of said lateral flaps starting from the support base according to a flap direction perpendicular to said creases is between 10% and 30% of the height of said containers, wherein said containers are aligned on said support base so that the main alignment direction is parallel to the longitudinal development direction, the contact between respective bottoms of said containers and said support base of said tray taking place in the absence of glue, where each gluing zone of each pair of gluing zones is defined on a respective free end portion of one of said flaps in a position opposite to said longitudinal development direction, in correspondence with each container.

9. The packaging of containers according to claim 8, wherein said tray comprises pre-cuts along a transverse direction perpendicular to said longitudinal development direction on said support base of said cardboard tray or paperboard tray for the creation of weakening lines which allow physical separation of a portion of said plurality of containers comprising said containers.

10. The packaging of containers according to claim 8, wherein images and texts are printed on said tray.

* * * * *